US005822939A

United States Patent [19]

Haener

[11] Patent Number: 5,822,939

[45] Date of Patent: Oct. 20, 1998

[54] INSULATED BUILDING BLOCK SYSTEM

[76] Inventor: Juan Haener, 8215 Harton Pl., San Diego, Calif. 92123

[21] Appl. No.: 805,361

[22] Filed: Feb. 24, 1997

[51] Int. Cl.[6] ..... E04B 1/74

[52] U.S. Cl. ..... 52/405.2; 52/286; 52/309.9; 52/404.1; 52/592.6; 52/606

[58] Field of Search ..... 52/100, 284, 286, 52/309.9, 404.1, 404.4, 405.1, 405.2, 405.3, 589.1, 592.6, 604.606, 608, 609

[56] References Cited

U.S. PATENT DOCUMENTS

| | | | |
|---|---|---|---|
| 2,199,946 | 5/1940 | Barnhart | 52/606 X |
| 2,737,801 | 3/1956 | Barnhart | 52/606 X |
| 3,888,060 | 6/1975 | Haener | 52/248 |
| 4,002,002 | 1/1977 | Barnhardt, Jr. | 52/405.2 X |
| 4,123,881 | 11/1978 | Muse | 52/100 |
| 4,148,166 | 4/1979 | Toone | 52/604 X |
| 4,640,071 | 2/1987 | Haener | 52/100 X |
| 4,854,097 | 8/1989 | Haener | 52/612 X |
| 5,193,318 | 3/1993 | D'Antonio et al. | 52/606 X |
| 5,379,565 | 1/1995 | Vienne | 52/606 |
| 5,575,128 | 11/1996 | Haener | 52/604 X |

*Primary Examiner*—Carl D. Friedman
*Assistant Examiner*—Kevin D. Wilkens
*Attorney, Agent, or Firm*—Frank D. Gilliom; John R. Duncan

[57] ABSTRACT

An insulated building block system for use in building walls and other structures. Each full block has sidewalls and endwalls with a generally open interior and flat upper and lower surfaces. Two vertical ridges are provided along the interior of one sidewall, with a protrusion extending above the upper surface. The ridges are located such that an upper block arranged in staggered relationship to a block in a lower course will interlock with the lower block. Recesses are provided in the interior endwall surfaces to retain a thermal insulation panel against the interior sidewall surface opposite the ridges. Half blocks are also provided to fill spaces in wall end surfaces between staggered full blocks. The half blocks have open interiors for placement of insulation panels and include ridges for interlocking with protrusions on adjacent full blocks.

8 Claims, 4 Drawing Sheets

INSULATED BUILDING BLOCK SYSTEM

FIELD OF THE INVENTION

This invention relates in general to blocks for use in construction of walls, buildings and the like and, more specifically, to a building block system including thermal insulation material.

BACKGROUND OF THE INVENTION

Conventional concrete block construction uses rectangular blocks, generally having one or more cavities through the blocks from top to bottom. A layer of mortar is thrilled onto a foundation and a course of closely spaced blocks are laid on the layer, with additional mortar applied between the contiguous block ends. Another layer of mortar is applied to the top of the first course and additional courses are similarly laid, generally staggering the block ends from course to course. Great care and skill is required to achieve level courses and a truly vertical wall. Because of the time and skill required for such construction, costs are high. These blocks have vertically aligned cavities that can be filled with rebar and concrete to reinforce the wall.

Various types of mortarless interlocking blocks have been devised in the past to facilitate the construction of block walls and other structures. Most such blocks have been very expensive to produce since the interlocking portions, usually grooves or protrusions, are normally cut into the blocks after they have been formed by molding. Further, it is difficult to maintain the required tight tolerances required for accurate construction of large walls or other structures through the molding and cutting steps. The prior blocks often required additional finishing or grinding steps to meet the require tolerances.

Excellent interlocking mortarless building blocks overcoming many of these deficiencies are describe in U.S. Pat. Nos. 3,888,060, and 4,640,071, both granted to the inventor of the present invention. Those blocks have been used successfully for many years. These blocks are assembled in courses, with the block joints staggered and continuous vertical open cells into which reinforcing bars ("rebar") and wet concrete can be inserted. While highly effective, these blocks require that rebar be inserted in lower courses, with blocks in later courses lifted over the ends of the rebar as the structure advances and wet concrete is periodically poured into the cells containing the rebar. Thus installing blocks over rebar can be a significant problem with tall structures.

Also, three or more different block configurations may be required for many structures, such as walls, buildings with openings and floor panels connected to the block wall. Additional block configurations require the manufacture of additional expensive molds and increased cost and time in changing molds in a block making machine and maintaining and inventory of the different block configurations.

Many of building walls made from these blocks have excessive thermal conductivity across the wall, which is a particular problem in cold climates where the interior is heated or in hot climates where the interior is cooled. Heat transmission across such a wall varies between areas where the blocks have large open internal cavities and areas where the cavities are filled with concrete and rebar reinforcements. In addition to the undesirable loss of interior heating or cooling through the wall, with heated buildings, cold spots may form on the interior of the wall that condense water from the inside atmosphere and run down the wall.

Attempts have been made to fill the block cavities with loose fiberglass insulation, loose foam particles, foamed in place materials, etc. Loose insulation tends to settle and provide very uneven insulation with resulting cold spots. The insulation cannot be placed in block cavities that are to be filled with concrete and rebar reinforcements, again resulting in thermal gradients along the wall, with widely varying interior wall temperatures at insulated and uninsulated areas.

Therefore, there is a continuing need for improvements in these successful block systems to permit lower cost block manufacture and lower cost, more rapid structure assembly from the blocks, the ability to provide thermal insulation in all blocks while still permitting the introduction of reinforcing concrete and rebar into all or some of the blocks and to place such reinforcement with insulation already in place.

SUMMARY OF THE INVENTION

The above noted problems are overcome, and advantages achieved, by a block system which includes two basic block configurations including a first, full, block, typically having a length at least twice the block width, and a second, half, block, typically no more than half the length of the long block, for filling in at wall ends and openings, etc., where long blocks are laid in staggered courses.

Each block includes an interior cavity extending the full block length between endwalls, with means along the endwalls for supporting and holding in place thermal insulation panels which may be made from closed cell foam material.

Each of said first, long, blocks has a pair of spaced, upright sidewalls each having flat top and bottom surfaces and generally parallel outermost side surfaces. The block face surfaces may have various decorative designs, as desired. Block end interlock means, typically cooperating vertically oriented tongue-and-groove arrangements, are provided at the ends of the sidewalls. Endwalls close the ends of the block between the sidewalls.

Two inwardly extending vertical ridges are provided along on sidewall which extend slightly above the block upper surface, forming protrusions that interlock with the lower ends of the ridges on the block laid in the next, above, course.

Half blocks are provided for filling the ends of walls between staggered full block courses. The half blocks are dimensioned the same as the full blocks, but are half the length of the full blocks and have a generally U-shaped plan, with a pair of spaced parallel sidewalls connected by an endwall at one end. The half block further includes tapered ridges running vertically along the inside surfaces of the sidewalls, arranged to interlock with an upwardly extending ridge protrusion on the next full block below the half block. Insulation may be placed along the sidewalls and endwall of the half block.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
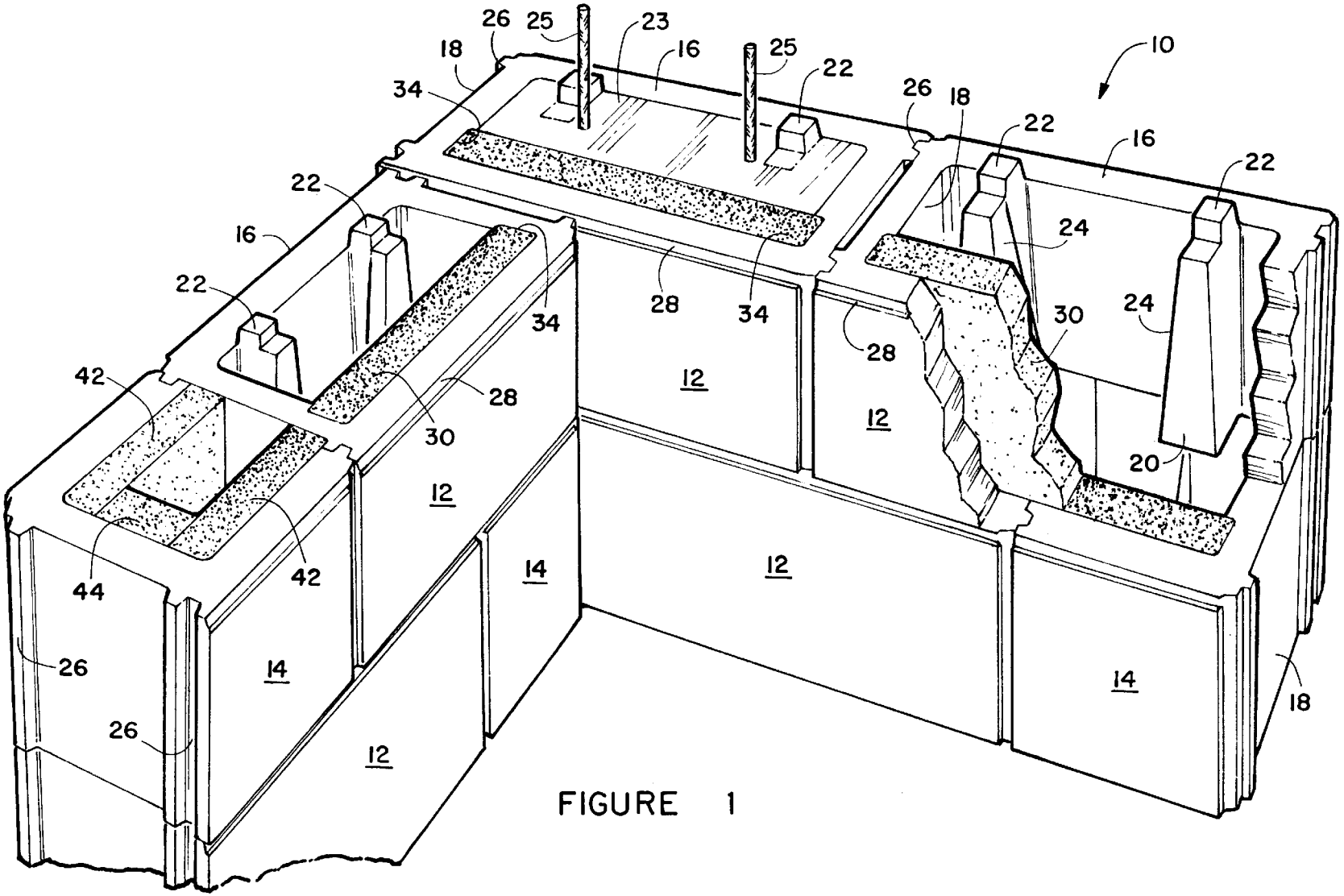
FIG. 1 is a perspective view of a wall built using the block system of this invention.

Referring to FIG. 1, there is seen a wall 10 primarily laid up in a staggered array from a plurality of full blocks 12. Each full block has a width equal to one-half its length. At the ends of a wall, every other course will have an opening equal to half a block 12. Half blocks 14 are provided to fill these spaces. Similar spaces will occur at the vertical edges of doors, windows and the like.

Figure 2:
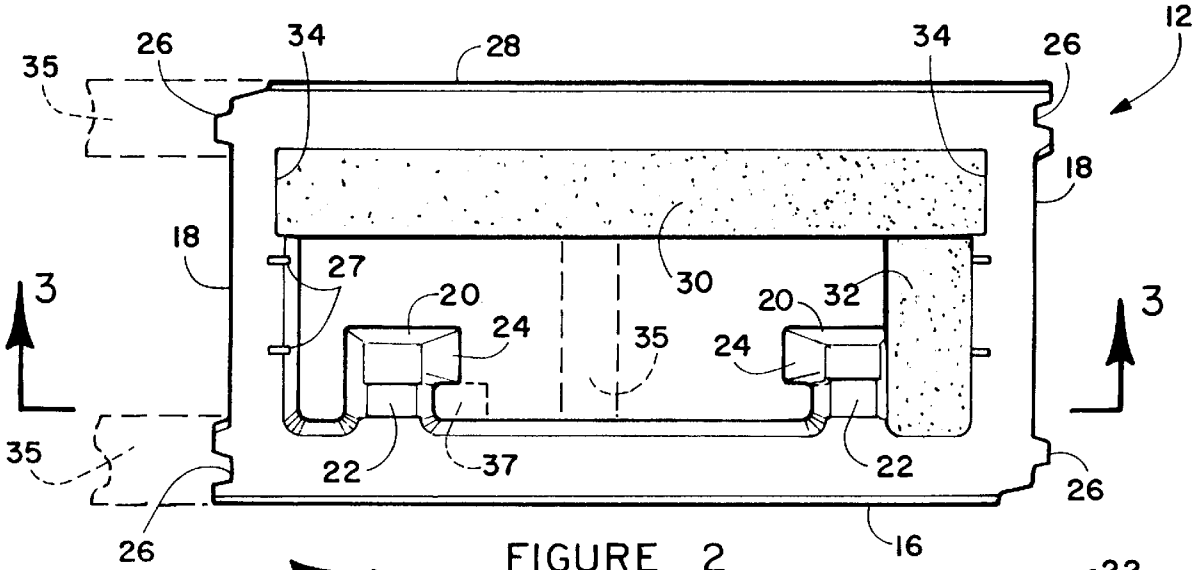
FIG. 2 is a plan view of a full block.
Figure 4:
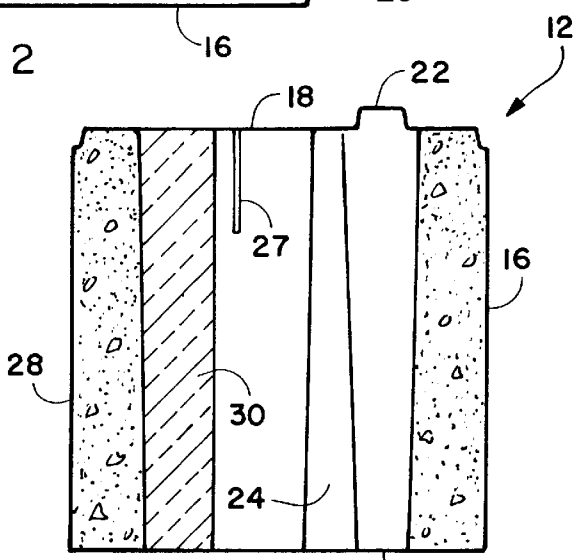
FIG. 4 is a section view taken on line 4—4 in FIG. 3.

As best seen in FIG. 2, the full blocks 12 each have two sidewalls 16 and 28 joined with two endwalls 18. The bottom surface of each block is substantially flat. Each full block 12 has a pair of inwardly extending vertical ridges on the inside of a first sidewall 16. Each ridge 20 has a distal protrusion 22 extending above the otherwise flat upper surface of each full block 12. Ridges 20 are located so that a protrusion 22 of a lower block 35 (as shown in broken lines in FIG. 2) will engage the proximal end of a ridge 20 as seen in FIG. 2 when the lower block extends half way along the upper block. Protrusion 22 is locked in place between the inner sidewall surface, the side of a ridge 20 and a tapered extension 24 along each ridge.

Since most of the block interior is open, cement grout 23 and rebar 25 can be easily be placed vertically through vertically aligned openings through blocks making up wall 10. As seen in FIG. 1, the entire interior of uppermost block 12 is filled with grout 23. The next lower blocks have endwalls meeting below the center of the upper block, with two spaced cavities that will fill with grout. The rebar 25 will extend through these cavities, together with the grout 23 poured in from above.

Figure 3:
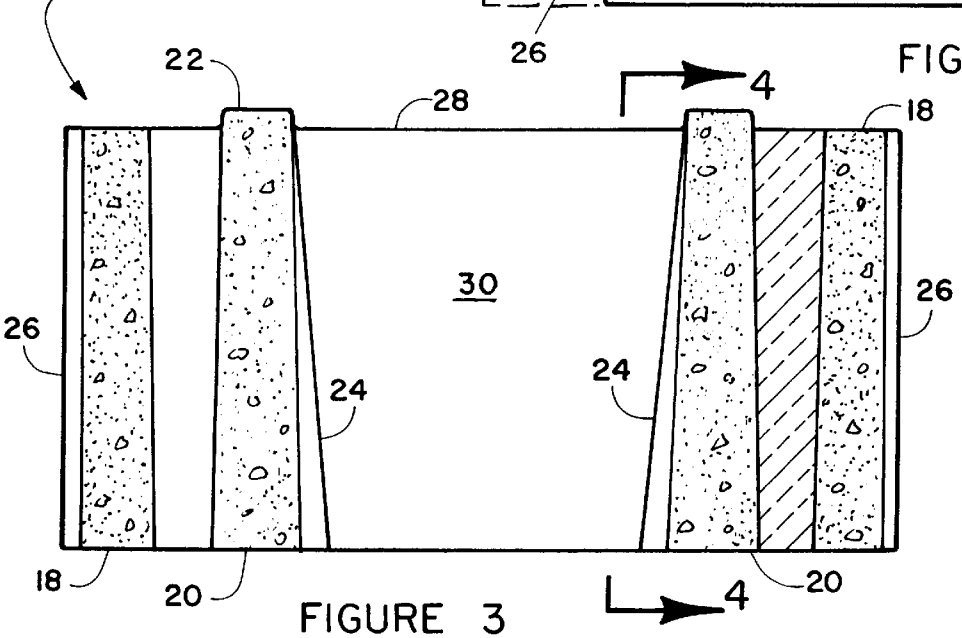
FIG. 3 is a section view taken on line 3—3 in FIG. 2.

Preferably, each block 12 includes tongue-and-groove interlocking means 26 at each to further hold blocks along a course in the proper position. Grooves 27 (FIGS. 2 and 3) may be provided in the upper inner edge of each endwall 18 so that a portion of the upper edge may be easily broke away to allow rebar to extend along the length of the course.

Each sidewall 18 has a vertical groove 34, continuous with second sidewall 28, to receive an end of an insulation panel 30 which is sized to cover the inner surface of sidewall 28. Where a particular full block has an end exposed at an end of a wall a small insulation panel 32 can be inserted along the exposed endwall 18, as seen in FIG. 2.

Figure 5:
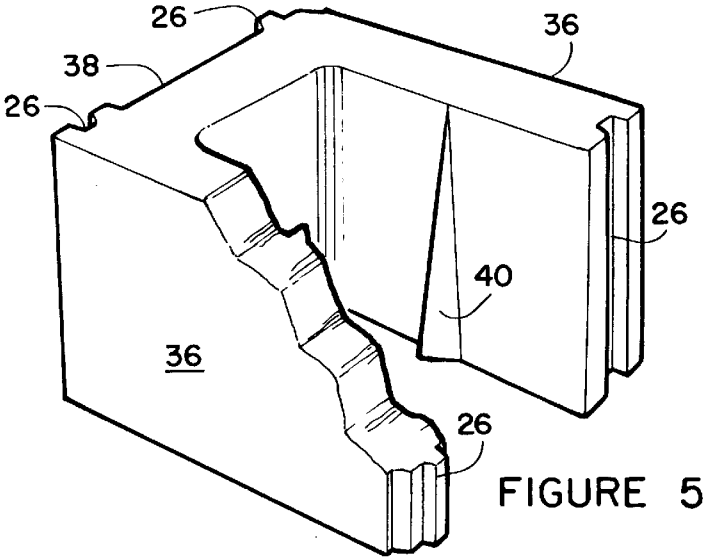
FIG. 5 is a perspective view of a half block.
Figure 6:
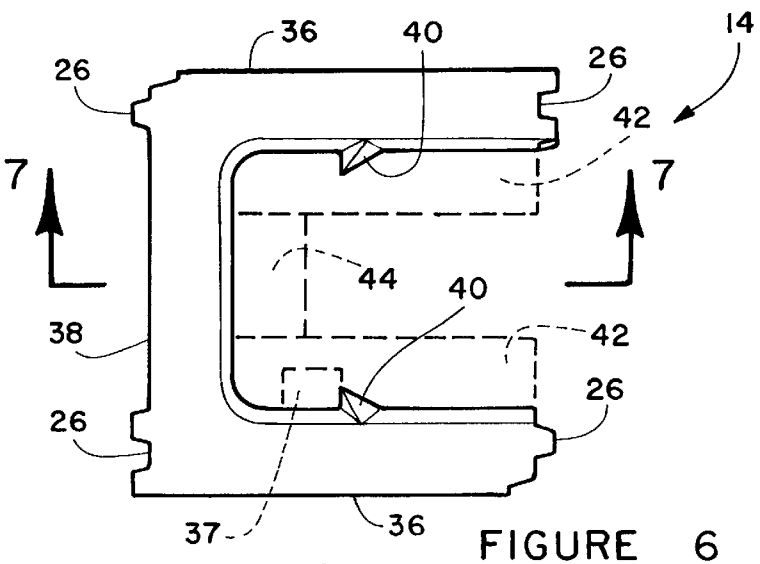
FIG. 6 is a plan view of a half block.
Figure 8:
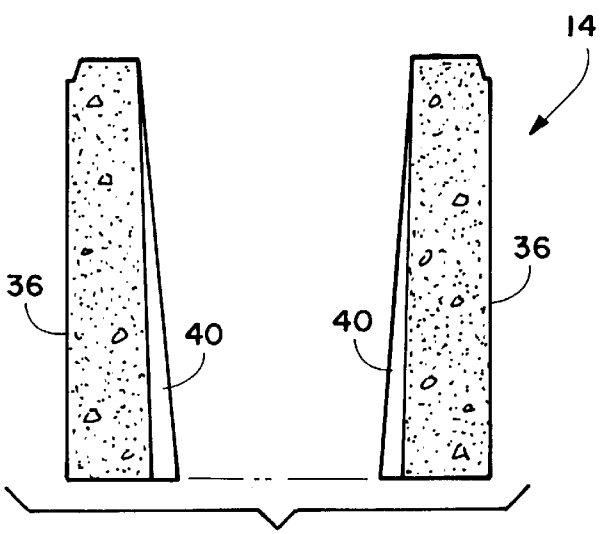
FIG. 8 is a section view taken on line 8—8 in FIG. 7.
Figure 7:
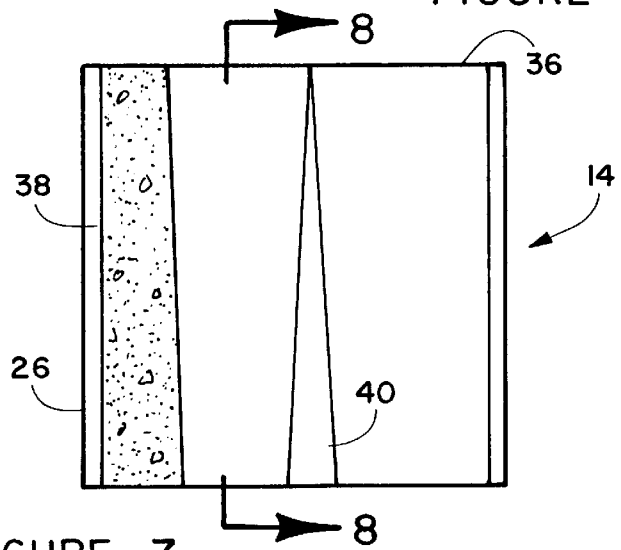
FIG. 7 is a section view taken on line 7—7 in FIG. 6.

A half block 14 as seen in FIGS. 5–7 is provided to fill in along wall ends, as mentioned above. Half block 14 has two parallel sidewalls 36 connected by an endwall. The half block sidewalls 36 have the same general configuration as full block sidewalls 16, except that they have half the length. A vertical tapered ridge 40 is provided along the inner surface of each sidewall 16, located to interlock with a protrusion 22 from a full block 12 immediately below a half block 14. A tapered ridge 40 is provided on each sidewall 36, so that the half block can be used at either a left or a right wall end.

A half block side insulation material 42 may be positioned along the interior of each sidewall 36, and a small panel 44 may be fitted between panels 42 across the interior of endwall 38 between panels 42. If desired, recesses may be provided in the inside edges of endwall 38, similar to recesses 34 shown in FIG. 2, and recesses could be provide in side insulation material 42 to receive ends of small insulation material sheets 44. The insulation material 42 can be molded to accommodate ridges 40 and protrusion 22 on the next lower block, which extend into volumes occupied by the insulation, or soft foam or fibrous insulation may be used that will simply compress when pressed into place over ridges and protrusions.

As each course is laid up, the various insulation panels are inserted before the next course is laid. If desired, the panels could be further adhesively bonded in place at the block manufacturing facility and shipped to the construction site. Once the wall is constructed to a suitable level, grout and rebar may be used to fill the vertical channel provided by the aligned openings in the blocks. Since the interior of the blocks are free of any structure, filling is easy and complete filling is assured. The final wall is sturdy and thermally insulated.

Figure 9:
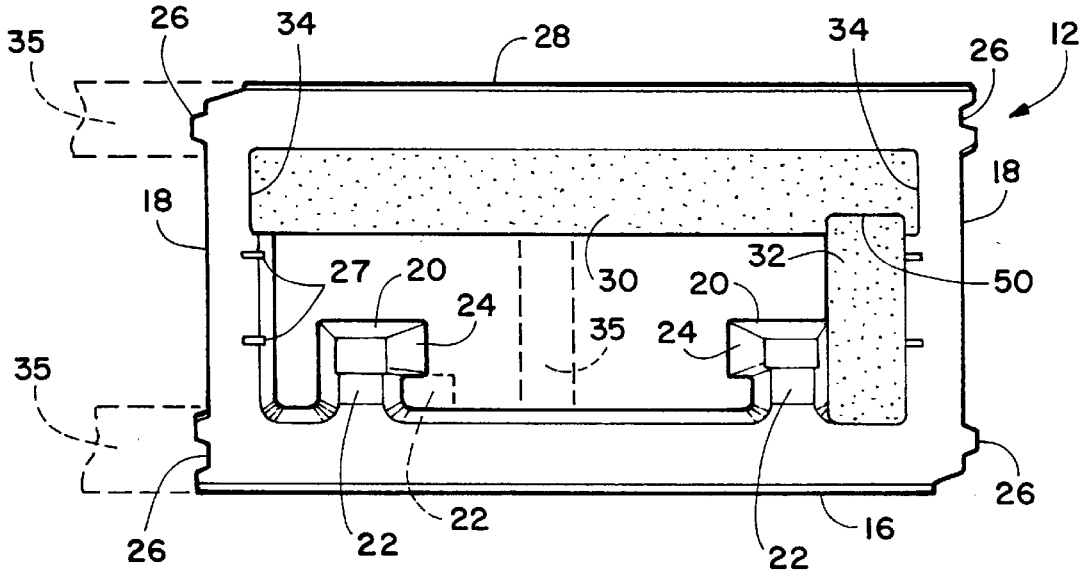
FIG. 9 is a plan view of an alternate embodiment having means for securing end insulation panels to side insulation panels.

FIG. 9 shows an alternate embodiment of the arrangement for securing end insulation panels 32 in place along the interior surface of endwall 18. A recess or groove 50 may be provided in insulation panel 30 into which an end of small end insulation panel 32 can be received. All other components shown are the same as shown in FIG. 2.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. An insulated, interlocking, block system for use in a wall construction which comprises:

at least one full block having a length substantially twice its width, said at least one full block comprising:

a pair of generally rectangular spaced parallel first and second sidewalls having substantially flat upper and lower surfaces and end edges generally perpendicular to said upper and lower surfaces;

a pair of generally rectangular spaced, parallel endwalls, each transverse to said sidewalls, joined to said sidewalls and having an internal and an external surface;

two inwardly extending ridges along said first sidewall each lying generally parallel to said end edges;

said ridges including ridge protrusions extending beyond said first sidewall upper surface;

said ridge protrusions located so that when one of said full blocks is placed over a second said block with said first sidewalls substantially coplanar and an endwall of the upper block substantially at the center of said lower block, a ridge protrusion on said lower block will interlock against a ridge of said upper block;

each endwall having an endwall groove on said internal surface, contiguous with said second sidewall, for receiving an edge of a sidewall insulation panel;

a panel of thermal sidewall insulation material fitted into said endwall grooves contiguous with said second sidewall; and a groove in said sidewall insulation panel for receiving a corresponding projection on an end of an endwall insulation panel for positioning said endwall insulation panel along an endwall interior surface.

2. The block system according to claim 1 wherein said at least one full block has an interior space between said side walls and between said endwalls that is substantially open and unobstructed prior to emplacement of insulation.

3. The block system according to claim 1 further including block to block interlock means at each block end.

4. The block system according to claim 1 further including at least one notch in each endwall interior surface extending from said upper surface partially through said endwall.

5. The block system according to claim 1, further including:

at least one half block having width and height substantially equal to the width and height of said at least one full block and a length substantially equal to half the length of said at least one full block, which comprises:

a pair of generally rectangular, spaced, parallel first and second sidewalls having substantially flat upper and lower surfaces and end edges generally perpendicular to said upper and lower surfaces;

a generally rectangular endwall, transverse to said sidewalls and joined to said sidewalls at one end of said sidewalls and having an internal and an external surface;

an inwardly extending tapered ridge along each of said sidewalls and having an edge lying generally parallel to said end edges;

said tapered ridges located so that when one of said half blocks is placed over a full block with a half block endwall aligned with one of said full block endwalls, a ridge protrusion will interlock with one of said tapered ridges.

6. The block system according to claim 5 further including insulating material along at least one interior surface of said half block.

7. The block system according to claim 6 wherein said insulation material comprises closed cell foam material.

8. The block system according to claim 6 further including block to block interlock means at each half block end.

* * * * *